US008884200B2

(12) United States Patent
Lovens

(10) Patent No.: US 8,884,200 B2
(45) Date of Patent: Nov. 11, 2014

(54) ELECTROMAGNETICALLY SHIELDED INDUCTOR ASSEMBLY

(75) Inventor: Jean Lovens, Embourg (BE)

(73) Assignee: Inductotherm Corp., Rancocas, NJ (US)

( * ) Notice: Subject to any disclaimer, the term of this patent is extended or adjusted under 35 U.S.C. 154(b) by 1191 days.

(21) Appl. No.: 12/567,781

(22) Filed: Sep. 27, 2009

(65) Prior Publication Data

US 2010/0080259 A1 Apr. 1, 2010

Related U.S. Application Data

(60) Provisional application No. 61/100,739, filed on Sep. 28, 2008.

(51) Int. Cl.
*H05B 6/10* (2006.01)
*H05B 6/36* (2006.01)

(52) U.S. Cl.
CPC . *H05B 6/104* (2013.01); *H05B 6/36* (2013.01)
USPC ..... 219/645; 219/646; 219/672; 219/673

(58) Field of Classification Search
USPC ..... 219/645, 632, 634, 672, 637, 646, 676, 219/662, 674, 673; 373/152; 174/352, 376, 174/350
See application file for complete search history.

(56) References Cited

U.S. PATENT DOCUMENTS

| | | | | |
|---|---|---|---|---|
| 4,761,530 A | | 8/1988 | Scherer et al. | |
| 5,214,258 A | * | 5/1993 | Akers | 219/645 |
| 5,317,121 A | * | 5/1994 | Katayama et al. | 219/672 |
| 6,083,329 A | * | 7/2000 | Tsuchiya et al. | 219/651 |
| 6,399,929 B1 | | 6/2002 | Hanton et al. | |
| 6,435,260 B1 | | 8/2002 | Fink et al. | |
| 6,963,056 B1 | * | 11/2005 | Peysakhovich et al. | 219/645 |
| 2002/0092845 A1 | | 7/2002 | Panczner | |
| 2005/0006120 A1 | * | 1/2005 | Lovens | 174/35 R |

FOREIGN PATENT DOCUMENTS

| | | | |
|---|---|---|---|
| JP | 27-2556 | A | 7/1952 |
| JP | 55-108698 | A | 7/1980 |
| JP | 2000-153351 | A | 6/2000 |
| JP | 2002-367763 | A | 12/2002 |
| JP | 2006-339044 | A | 12/2006 |

OTHER PUBLICATIONS

Valery I. Rudnev, Systematic analysis of induction coil failures, Heat Treating Process, pp. 15-16, Mar./Apr. 2007, Madison Heights, MI.

* cited by examiner

*Primary Examiner* — Henry Yuen
*Assistant Examiner* — Hung D Nguyen
(74) *Attorney, Agent, or Firm* — Philip O. Post

(57) ABSTRACT

An openable induction coil is provided. An electromagnetically shielded inductor assembly can be formed from the openable induction coil and an electromagnetically shielded enclosure into which the coil can be inserted. The induction coil can be pivoted open while in the shielding enclosure without complete disassembly of the enclosure. In some examples of the invention, a dynamic "curtain" of a gas is injected through spaces between opening portions of the coil and adjacent sections of the shielding enclosure, and into the interior of the induction furnace formed by the openable induction coil when it is in the closed position.

10 Claims, 16 Drawing Sheets

ELECTROMAGNETICALLY SHIELDED INDUCTOR ASSEMBLY

CROSS REFERENCE TO RELATED APPLICATIONS

This application claims the benefit of U.S. Provisional Application No. 61/100,739, filed Sep. 28, 2008, hereby incorporated by reference in its entirety.

FIELD OF THE INVENTION

The present invention generally relates to an induction coil through which a workpiece is passed so that the workpiece can be inductively heated, and in particular, to such an induction coil that can be opened to allow maintenance to be performed with minimal disturbance of an electromagnetic shield assembly in which the induction coil can be enclosed to form an electromagnetically shielded inductor assembly.

BACKGROUND OF THE INVENTION

A closed solenoidal induction coil can be used to inductively heat a material by passing the material through the coil while alternating current of a suitable frequency is supplied to the coil. Closed induction coils can be difficult to maintain. Electromagnetic shielding of induction coils is typically required to meet industrial and personal standards.

U.S. Pat. No. 4,761,530 discloses a box-like inductor assembly having an openable side door so that the inductor assembly can be laterally moved away from a continuous metal strip surrounded by the inductor assembly when the side door is closed. U.S. Pat. No. 5,317,121 discloses an induction coil having a gap through which through which a continuous metal strip can move laterally through so that it is either surrounded by the coil or moved out of the coil. U.S. Pat. No. 5,495,094 discloses various induction coils having a gap through which a continuous metal strip can move laterally through. U.S. Pat. No. 5,837,976 ("the '976 patent") discloses various arrangements of induction coils having a gap through which a continuous metal strip can move laterally through. In some embodiments, the '976 patent discloses flexible interconnecting member(s) of the induction coil so that the flexible interconnecting member(s) can be spread apart to increase the size of the gap as shown in FIG. 9*a*, FIG. 9*b*, FIG. 10*a* and FIG. 10*b* of the '976 patent.

International Publication No. WO 2005/004559 A2 discloses an electromagnetic shield for use with induction coils incorporating a gap as described, for example, in the above patents. The electromagnetic shield also incorporates at least one gap so that a continuous metal strip can move laterally in and out of the induction coil and surrounding electromagnetic shield through the gaps in the induction coil and electromagnetic shield.

International Publication No. WO 2007/081918 A2 discloses an electromagnetically shielded induction heating apparatus that includes a substantially gas tight enclosure and electromagnetic shield material. The induction heating apparatus/coil surrounding the gas tight enclosure is not openable.

Japanese patent publication JP 63-4873 (published 1988 and now in the public domain) discloses a method of blowing hot air through a non-openable induction furnace to prevent the formation of dew from vapors released by a coating material in the furnace.

It is one object of the present invention to provide an electromagnetically shielded openable induction coil that can be conveniently opened for maintenance with minimal disturbance of a surrounding electromagnetic shield structure that forms an inductor assembly with the coil.

It is another object of the present invention to provide an electromagnetically shielded inductor assembly having an openable induction coil that can be easily inserted or removed from the electromagnetically shielded enclosure, and can be opened while the induction coil is in the electromagnetically shielded enclosure without complete disassembly of the enclosure.

It is another object of the present invention to provide an electromagnetically shielded inductor assembly having an openable induction coil that can be provided with a static or dynamic seal between the interface regions of the openable induction coil and the electromagnetically shielded inductor assembly so that a gastight seal can easily be maintained between the induction coil and the electromagnetic shield inductor assembly when the induction coil is in the closed position while maintaining an efficient method of opening and re-closing the induction coil without resealing of the seal.

It is another object to the present invention to provide apparatus and a method of injecting a gas into an induction furnace having an openable induction coil as an improvement to the disclosure of Japanese patent publication JP 63-4873.

BRIEF SUMMARY OF THE INVENTION

In one aspect the present invention is an openable induction coil that can be swung open to allow maintenance of the induction coil.

In another aspect the present invention is an electromagnetically shielded inductor assembly comprising an openable induction coil removably inserted into an electromagnetically shielding enclosure. The coil can be pivoted open while in the shielding enclosure with only partial disassembly of the shielding enclosure. In some examples of the invention, a dynamic "curtain" of a gas is injected through spaces between opening portions of the coil and adjacent sections of the shielding enclosure into the interior of the induction furnace formed by the openable induction coil when it is in the closed position.

The above and other aspects of the invention are set forth in this specification and the appended claims.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 2(*b*) is a cross sectional view of the openable induction coil shown in FIG. 2(*a*) with the coil shown in an open position.

FIG. 3(*b*) is an isometric view of the electromagnetically shielded inductor assembly shown in FIG. 3(*a*) with the openable induction coil shown in dotted outline relative to the electromagnetically shielded enclosure in which the coil is located.

FIG. 3(*c*) is an isometric view of the electromagnetically shielded enclosure shown in FIG. 3(*a*) without the openable induction coil shown.

FIG. 3(*d*) is a cross sectional view of the electromagnetically shielded enclosure shown in FIG. 3(*c*) through line C-C.

FIG. 4(*b*) is a cross sectional view of the electromagnetically shielded inductor assembly shown in FIG. 4(*a*) with the openable induction coil shown in an open position while within the electromagnetically shielded enclosure.

FIG. 6(*b*) is a cross sectional view of the electromagnetically shielded inductor assembly shown in FIG. 6(*a*) with the openable induction coil shown in an open position while within the electromagnetically shielded enclosure.

FIG. 7(*b*) is a partial cross sectional side elevation of the example of the air curtain arrangement shown in FIG. 7(*a*) through line E-E in FIG. 7(*a*).

FIG. 7(*c*) is a partial cross sectional side elevation of another example of an air curtain arrangement used with the electromagnetically shielded inductor assembly shown in FIG. 3(*a*).

FIG. 7(*d*) is a side elevation view of the air curtain gas distribution plenum shown in FIG. 7(*a*).

FIG. 7(*e*) is a cross sectional elevation view of another air curtain distribution plenum used with the electromagnetically shielded inductor assembly shown in FIG. 3(*a*).

FIG. 8(*a*) is a partial top plan view of one example of a gas (air) curtain used with the electromagnetically shielded inductor assembly shown in FIG. 5.

FIG. 8(*b*) is a partial cross sectional side elevation of the example of the air curtain arrangement shown in FIG. 8(*a*) through line F-F in FIG. 8(*a*).

FIG. 8(*c*) is a partial cross sectional side elevation of another example of an air curtain arrangement used with the electromagnetically shielded assembly in FIG. 5.

FIG. 8(*d*) is a side elevation view of the air curtain gas distribution plenum shown in FIG. 8(*a*).

FIG. 8(*e*) is a cross sectional elevation view of another air curtain distribution plenum used with the electromagnetically shielded inductor assembly shown in FIG. 5.

FIG. 12(*b*) is a cross sectional view of the electromagnetically shielded inductor assembly through line G-G in FIG. 12(*a*)

FIG. 13(*b*) illustrates one example of the use of distributed tank capacitive elements with an openable induction coil of the present invention.

FIG. 13(*c*) is one example of an arrangement of an electromagnetically shielded inductor assembly of the present invention and the supply of alternating current to the multiple openable induction coils used in the electromagnetically shielded inductor assembly.

DETAILED DESCRIPTION OF THE INVENTION

Figure 1:
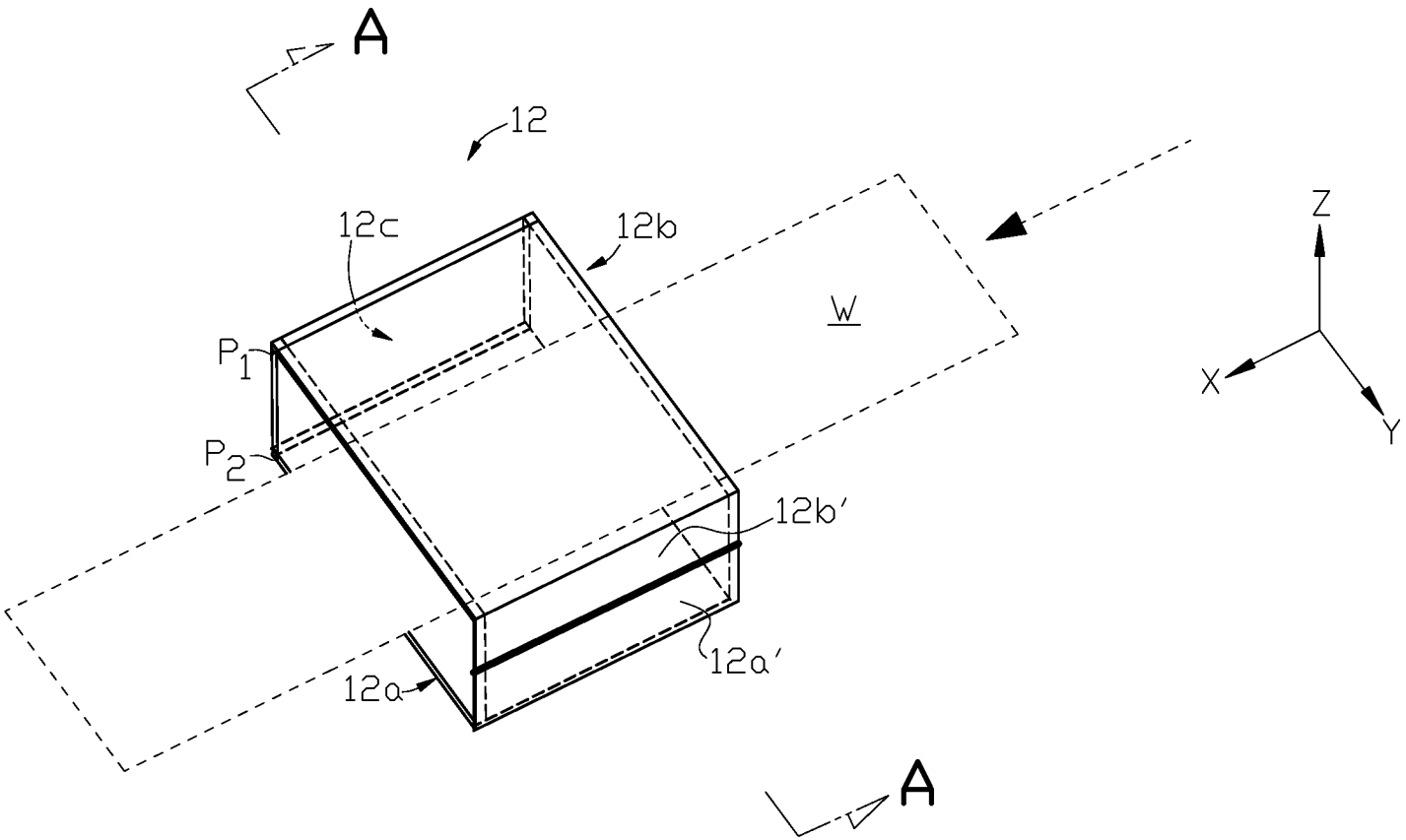
FIG. 1 is an isometric view of one example of an openable induction coil of the present invention.
Figure 2B:
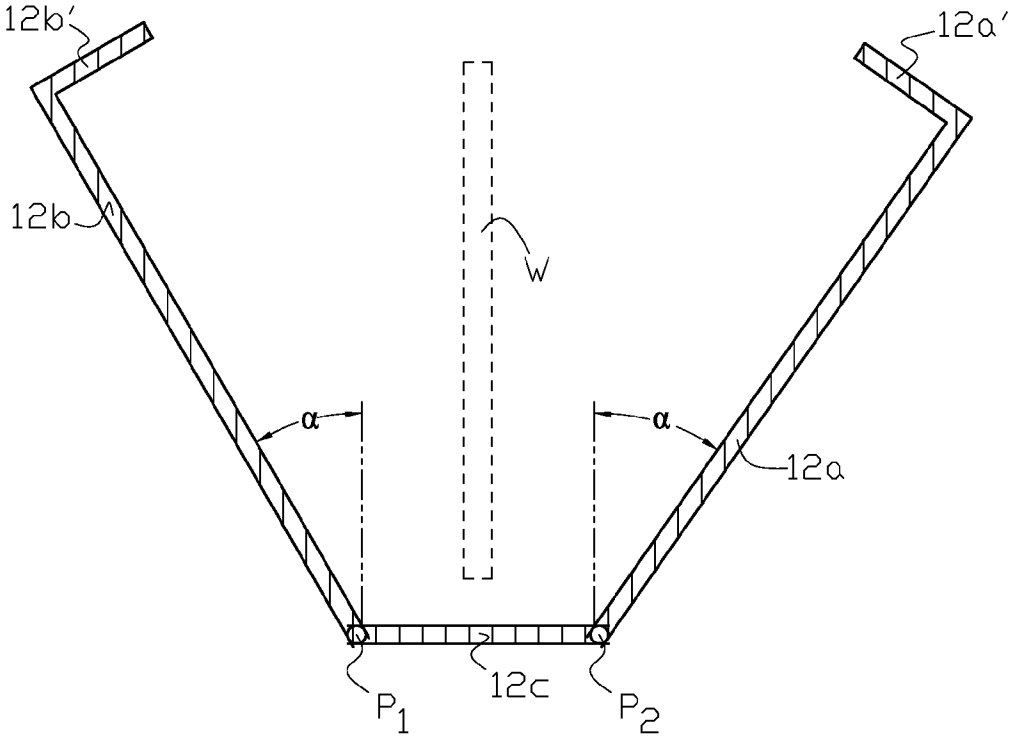
FIG. 2(*a*) is a cross sectional view of the openable induction coil shown in FIG. 1 in the closed position through line A-A in FIG. 1 with the cross sectional view rotated ninety degrees counterclockwise.
Figure 2A:
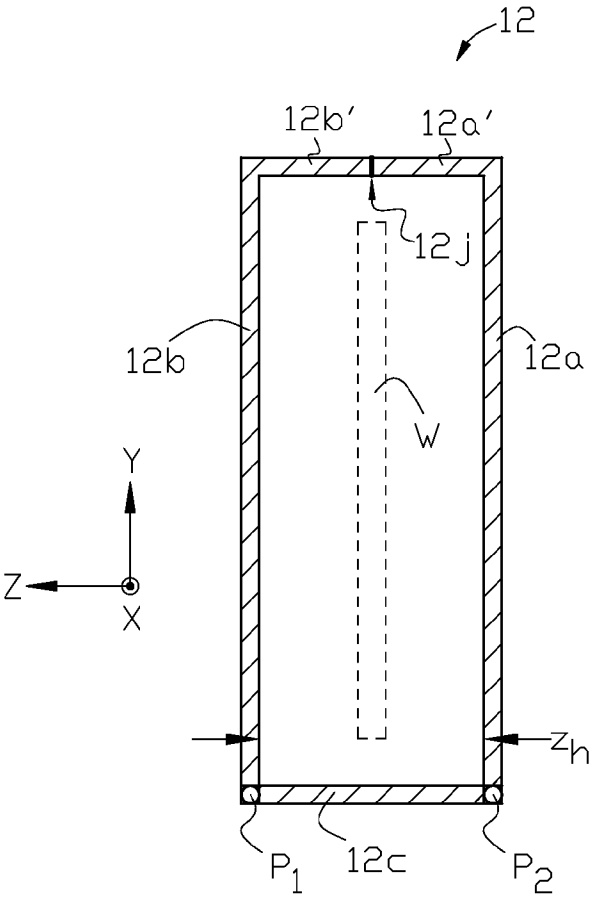

FIG. 1 illustrates one example of an openable induction coil 12 of the present invention. Workpiece W, for example a continuous or discrete metal strip, moves through openable induction coil 12 when it is in the closed position as shown in FIG. 1 and FIG. 2(*a*). Induction coil 12 is suitably connected to a source of alternating current so that a magnetic flux field is established around the induction coil. The magnetic flux field couples with the workpiece passing through the induction coil and inductively heats the workpiece.

As shown in FIG. 2(*b*), in one non-limiting example of the invention, induction coil sections 12*a* and 12*b* can be pivoted (swung) widely open for maintenance of the inside of the coil, for example, to remove dust or other particulate from the interior of the induction coil, or to repair refractory, if used. For purposes of this example only, coil section 12*a* can be referred to as the bottom coil section; coil section 12*b* can be referred to as the top coil section; coil section 12*c* can be referred to as the right side coil section; and subsections 12*a*' and 12*b*', in combination, can be referred to as the left side coil section.

In this example induction coil section 12*c*, which effectively represents the height, $z_h$, (FIG. 2(*a*)) of the interior induction heating space (or furnace) of the induction coil when it is in the closed position, can be stationarily mounted, while swingable induction coil sections 12*a* and 12*b*, including subsections 12*a*' and 12*b*', respectively, which subsections, in combination, represent the side of the induction furnace opposing the side of induction coil section 12*c* when the induction coil is in the closed position. In this arrangement subsections 12*a* and 12*b* can each be swung open to an adjustable angle $\alpha$ as shown in FIG. 2(*b*) across the entire height of the interior of the induction furnace. This is of particular advantage in servicing the inside surface of the induction coil, for example, for manual removal of hardened deposits on the interior of the coil that build up during use of the inductor assembly.

Figures 8A, 8B, 8C, 8D, 8E, 9:
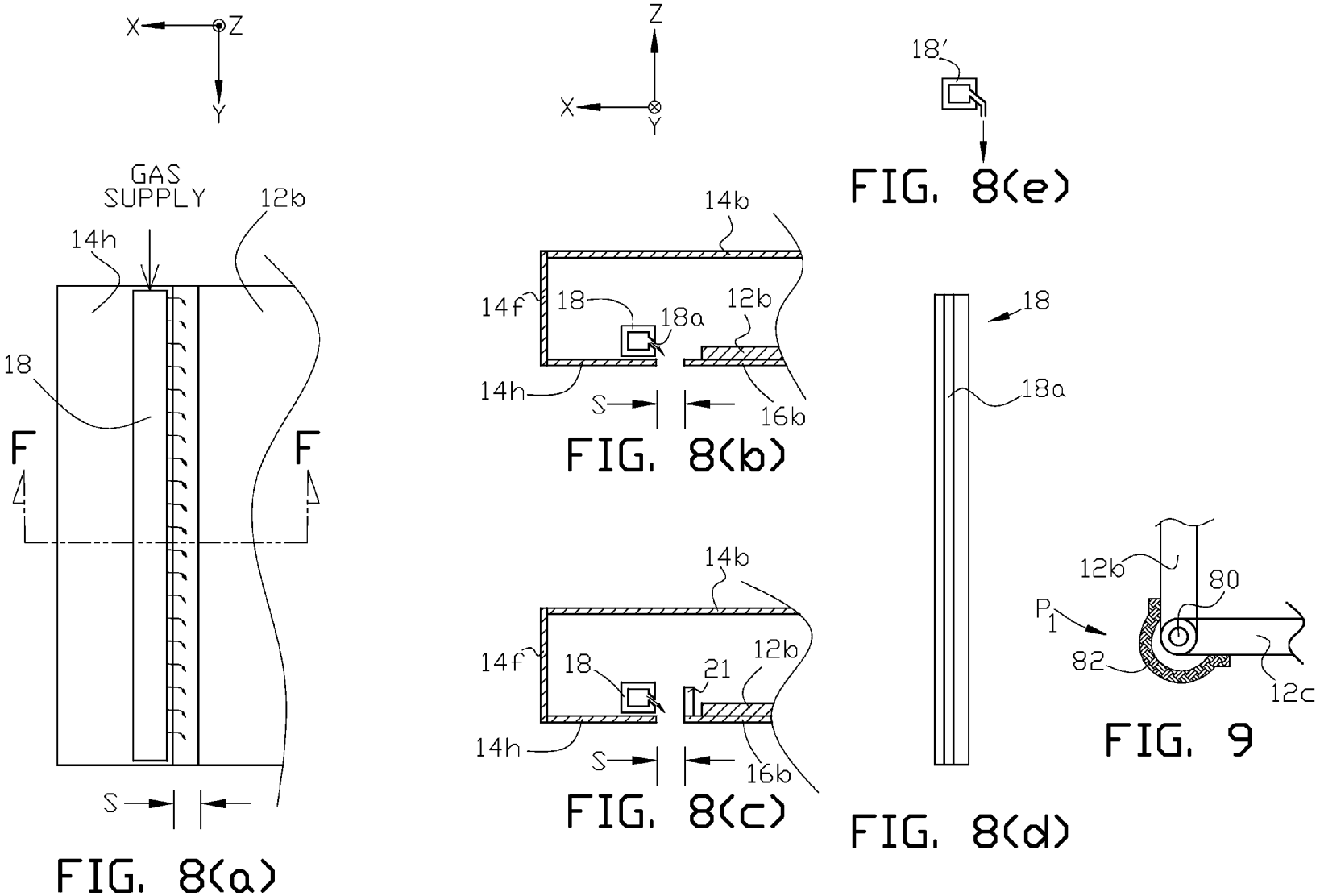
FIG. 9 is a partial illustration of one type of electrical connection across a pivoting element connecting two induction coil sections of an openable induction coil used in the present invention.

One non-limiting method of providing the pivoting axes is illustrated in FIG. 9. For example mechanical pivot element 80, such as a hinge, provides physical connection between two induction coil sections 12*b* and 12*c* while flexible electrical conductor 82, such as a flexible copper braid, provides electrical continuity across the mechanical hinge to form pivoting axis $P_1$. A similar arrangement may be used to form pivoting axis $P_2$. In other examples of the invention the mechanical pivot element may also serve as the electrical connection between the two induction coil sections.

Figure 10:
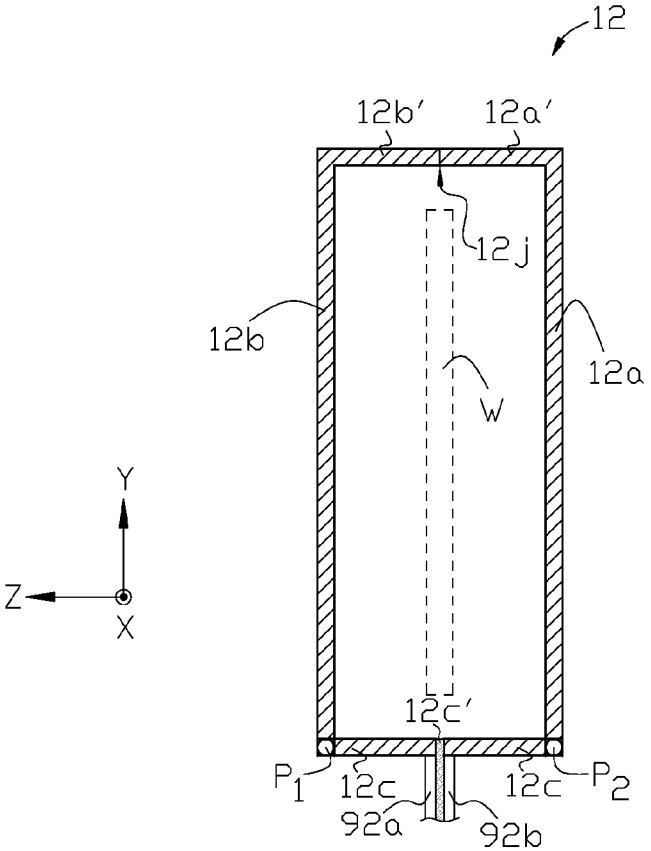
FIG. 10 illustrates one method of supplying alternating current to the openable induction coil shown in FIG. 2(*a*).

One example of supplying alternating current to induction coil 12 is shown in FIG. 10. Induction coil section 12*c* is separated electrically by suitable electrical insulation 12*c*' to establish connection points for supply 92*a* and return 92*b* electrical conductors that can be connected to a suitable source of alternating current.

Figure 3A:
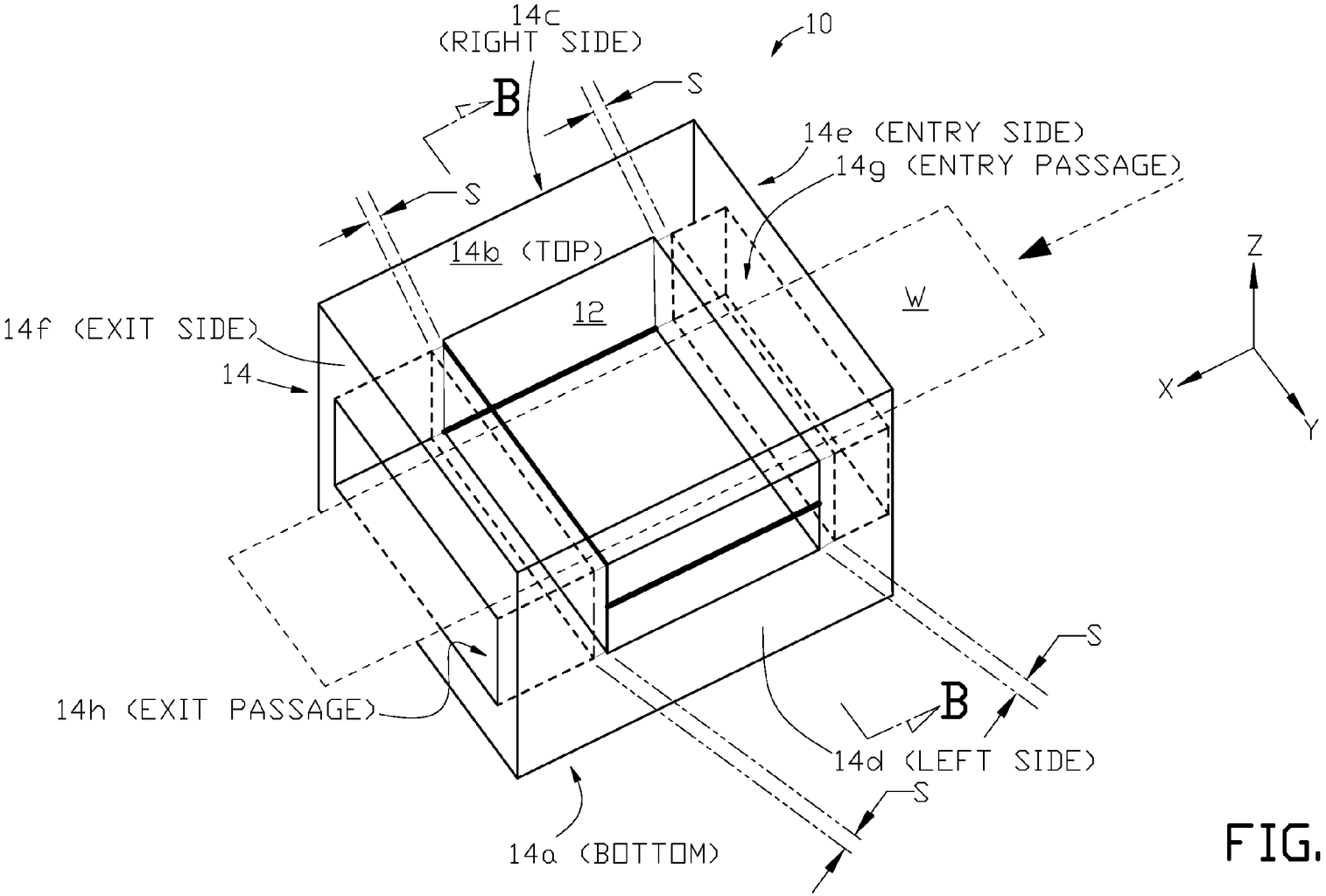
FIG. 3(*a*) is an isometric view of one example of an electromagnetically shielded inductor assembly of the present invention.
Figure 3B:
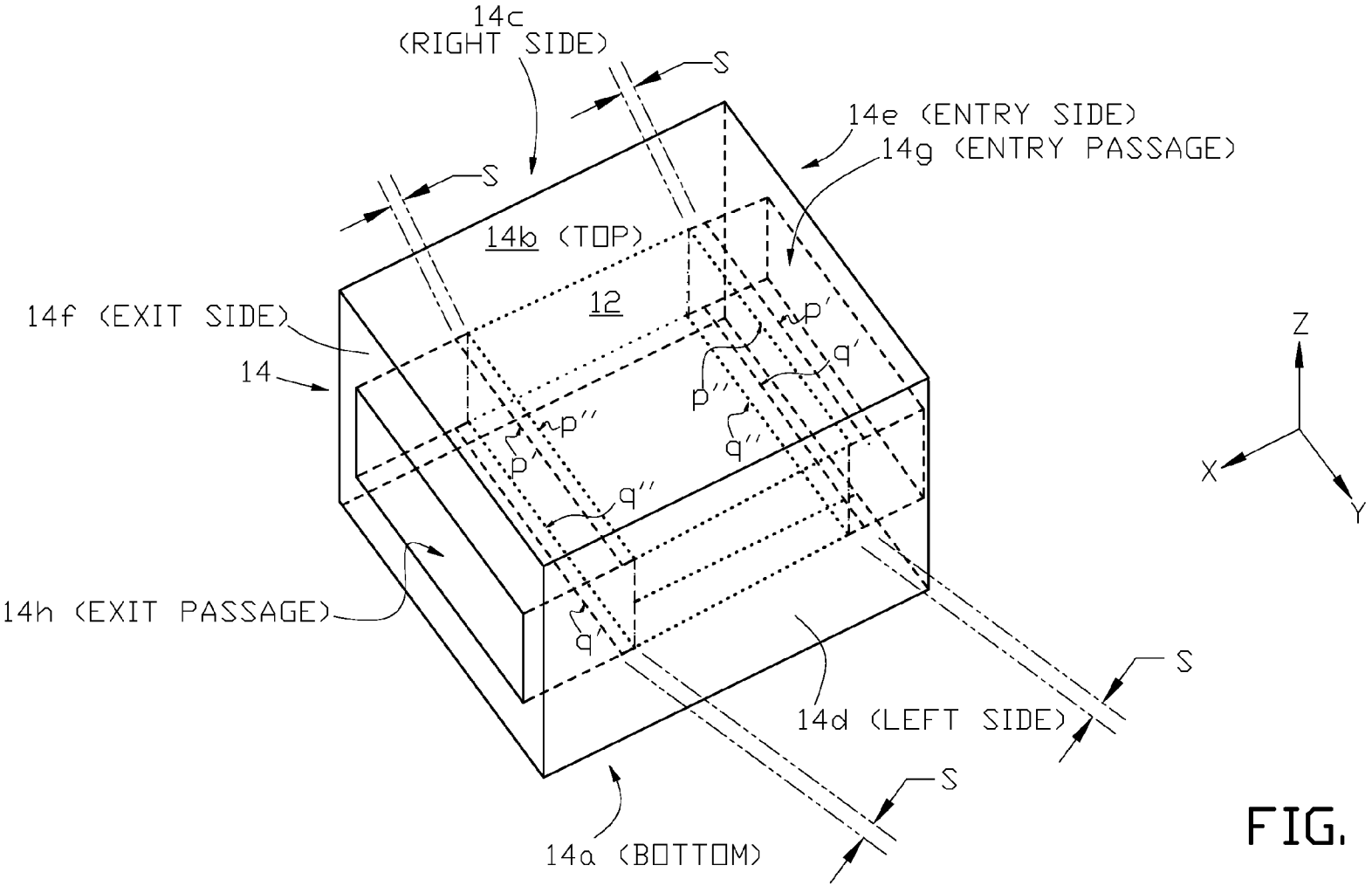
Figures 3C, 3D:
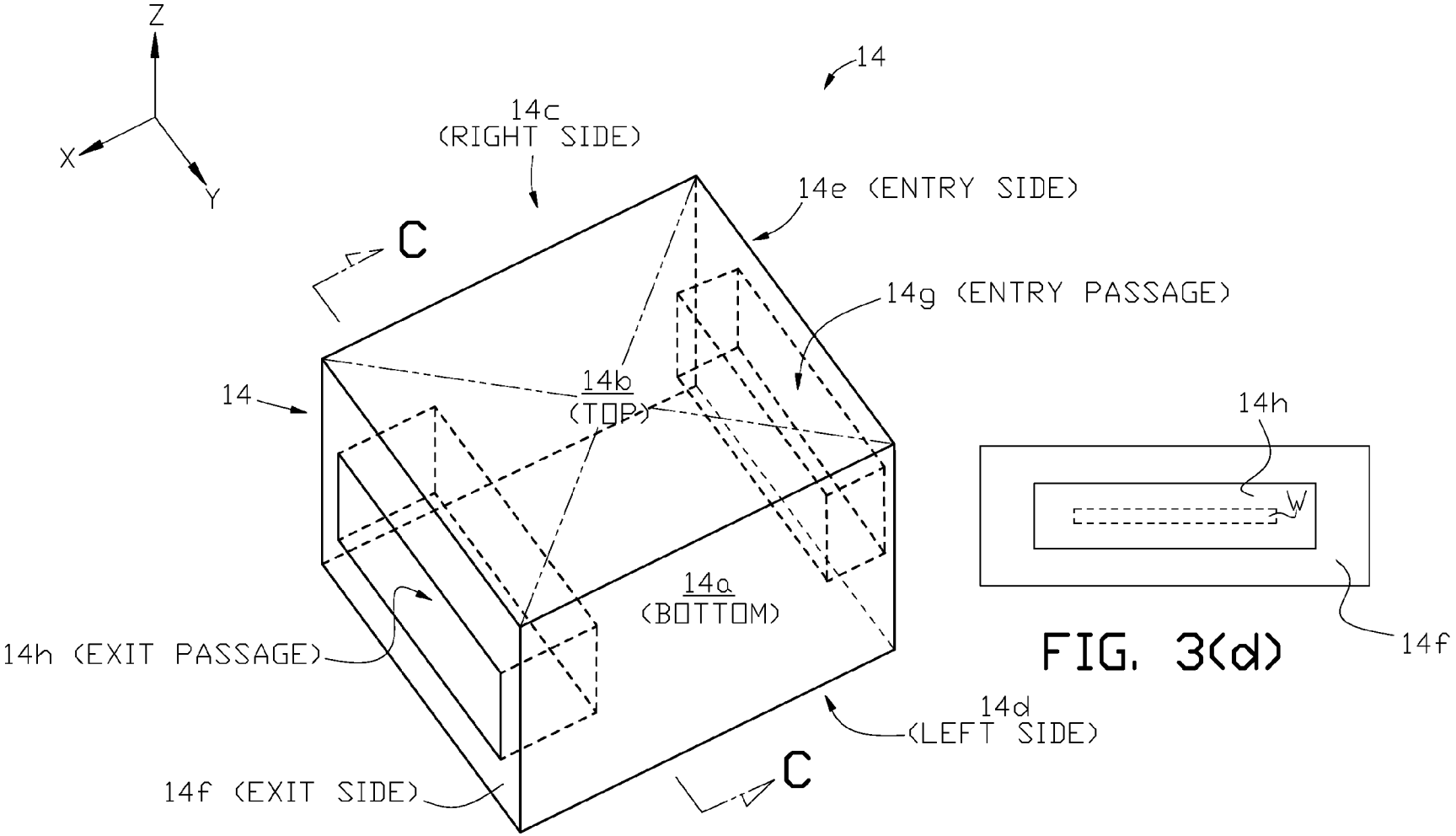

FIG. 3(*a*) illustrates one example of the electromagnetically shielded inductor assembly 10 of the present invention wherein openable box-like induction coil 12 is disposed within box-like electromagnetically shielded enclosure 14. In accompanying FIG. 3(*b*) induction coil 12 is shown in dotted outline while enclosure 14 is shown in solid and dashed (to indicate hidden) lines. In FIG. 3(*c*) only enclosure 14 is shown for clarity of the structure of the electromagnetically shielded enclosure used in this example of the invention.

In this example of the invention electromagnetically shielded enclosure 14 comprises box-like outer electrically conducting structure formed from longitudinal (relative to orientation of workpiece W) sides 14*a*, 14*b*, 14*c* and 14*d*; transverse (relative to orientation of workpiece W) entry 14*e* and exit 14*f* sides; and box-like inner workpiece entry passage 14*g* and workpiece exit passage 14*h*. In a particular oriented example of the present invention, side 14*a* may be referred to as the bottom of enclosure 14; side 14*b* may be referred to as the top of the enclosure; side 14*c* may be referred to as the right side of the enclosure; and side 14*d* may be referred to as the left side of the enclosure. Side 14*a* through 14*f* are formed from any suitable electrically conductive material either in solid or other form, such as a mesh. Box-like inner workpiece entry passage 14*g* and exit passage 14*h* form a closed entry path to, and closed exit path from, the interior of the induction furnace to the exterior of the electromagnetically shield enclosure and may be formed from a suitable non-electrically conductive material. While workpiece entry passage 14*g* and workpiece exit passage 14*h* are shown as closed rectangularly box structures, in other examples of the invention they may be of other shapes as long as they provide a closed workpiece entry passage from entry side 14*e* of enclosure 14 to the entrance of the induction furnace, and a closed workpiece exit passage from the exit of the induction furnace to exit side 14*f* of enclosure 14, except for spaces, S, as further described below.

As seen for example in FIG. 3(*b*), at least the top and bottom interior perimeters (p' and q') of the workpiece entry and exit passages 14*g* and 14*h* interface with the entry and exit perimeters (p" and q") of the induction furnace. A space (or gap), S, can be provided in this interface region so that a tolerance is maintained between the openable induction coil sections and the workpiece entry and exit passages. This tolerance can be beneficial in accommodating fit of the openable induction coil when it is in the closed position, for example, to account for heat expansion or contraction of the sections of the electromagnetically shielded enclosure or the openable induction coil. In a particular application a space may not be required between the lateral side perimeter interfaces of the entry and exit passages and the induction furnace (sides 12*c* and 12*d*) as shown in FIG. 3(*b*).

Workpiece W moves through electromagnetically shielded inductor assembly 10 in an interior volume defined by the interior of the induction furnace and the interiors of workpiece entry and exit passages 14*g* and 14*h* of enclosure 14. Assembly 10 comprises openable induction coil 12 and enclosure 14. With this configuration the enclosure forms an electromagnetically shielding box structure around the openable induction coil.

Figure 4B:
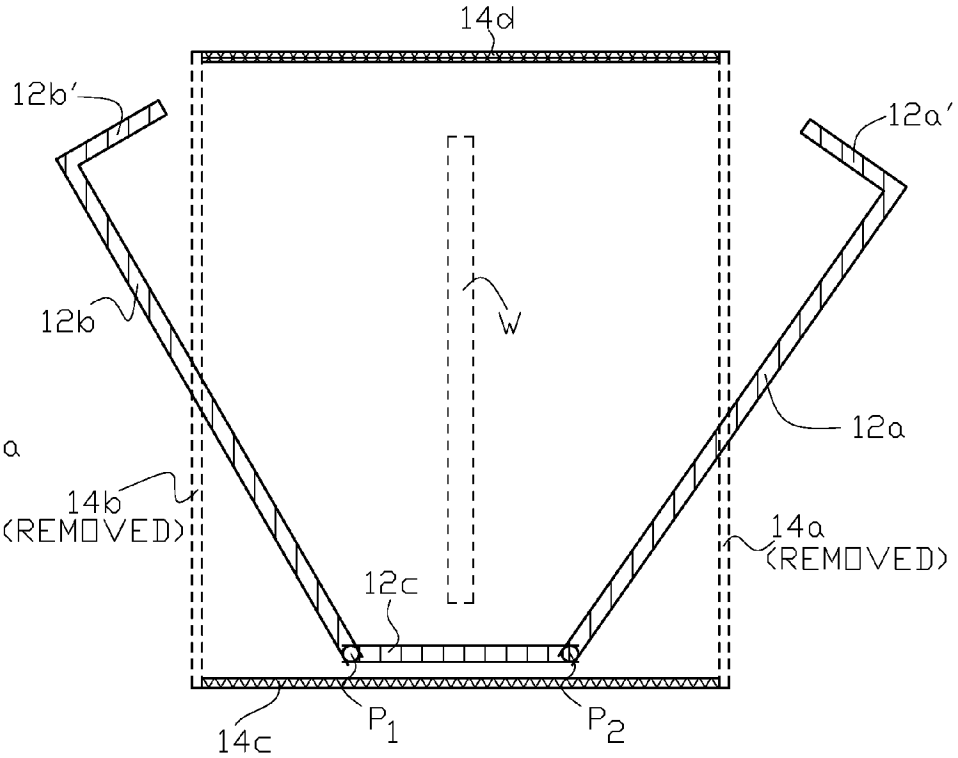
FIG. 4(*a*) is a cross sectional view of the electromagnetically shielded inductor assembly shown in FIG. 3(*a*) through line B-B in FIG. 3(*a*) with the openable induction coil shown in the closed position and the cross sectional view rotated ninety degrees counterclockwise.
Figure 4A:
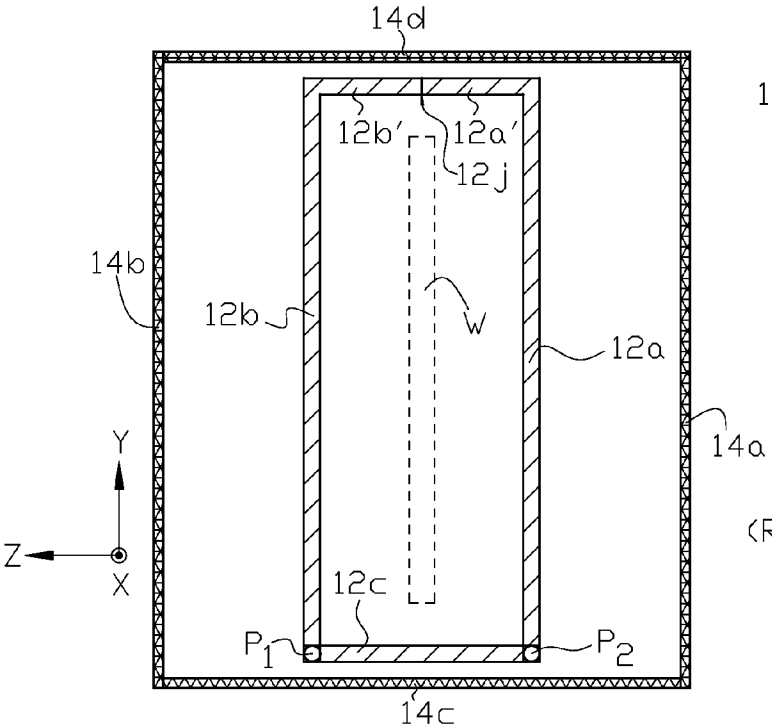

As shown in FIG. 4(*b*), in one non-limiting example of the invention, induction coil sections 12*a* and 12*b* can swing widely open for maintenance, about pivot axes $P_1$ and $P_2$ when the bottom and top sides (or panels) 14*a* and 14*b* (shown in dashed lines as being removed) of enclosure 14 are moved at least partially from the planes in which they are installed. Therefore coil sections 12*a* and 12*b* can swing through the installed planes of panels 14*a* and 14*b* without further disassembly of the electromagnetically shielded enclosure. The term "moved" relative to the moveable sides of enclosure 14 includes complete removal of a side or panel, for example, swinging a side open about a pivot axis, or otherwise moving the side or panel of enclosure 14 so that a moveable coil section can open at least partially through the installed plane defined when a moveable panel is in the installed position.

Suitable locking apparatus can be provided so that when induction coil 12 is in the closed position sufficient contact is maintained between the opposing edges of coil subsections 12*a*' and 12*b*' so that electrical continuity is maintained across the opposing edges of the two coil subsections at joint 12*j* as shown, for example, in FIG. 4(*a*).

Figure 5:
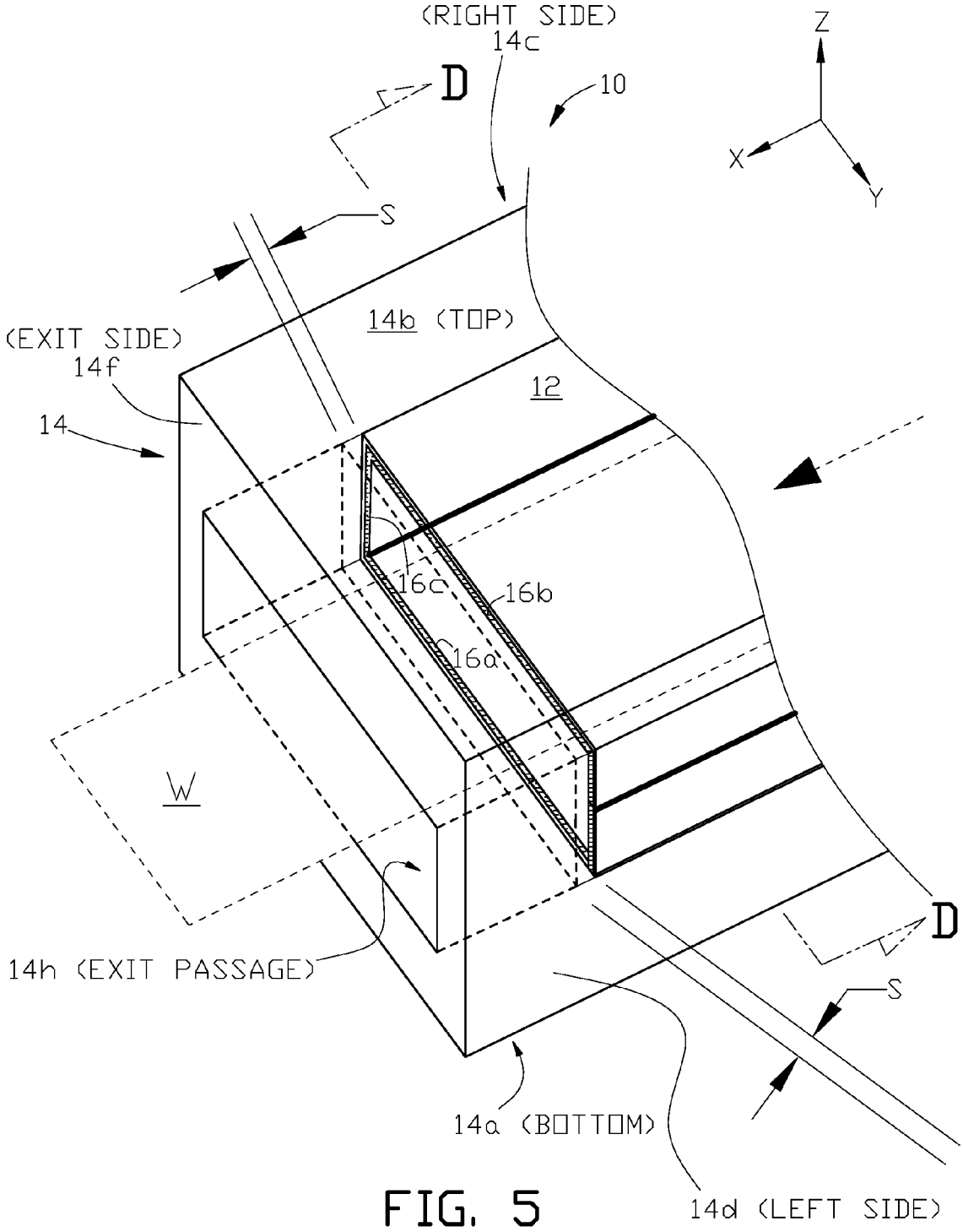
FIG. 5 is an isometric view of another example of the electromagnetically shielded inductor assembly of the present invention.
Figure 6B:
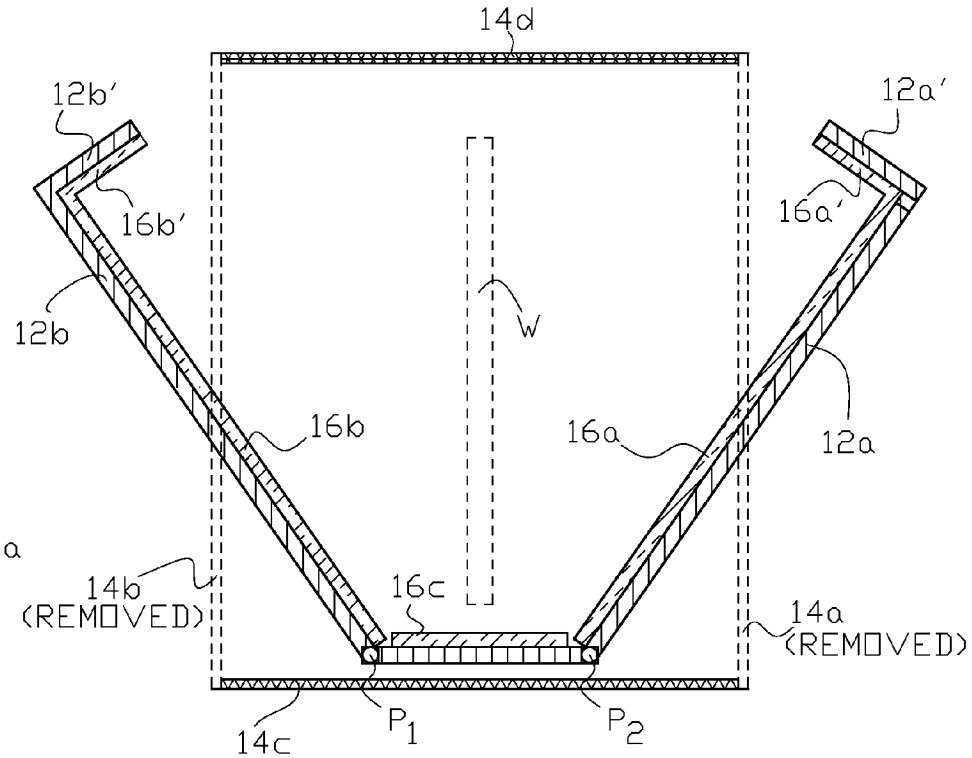
FIG. 6(*a*) is a cross sectional view of the electromagnetically shielded inductor assembly shown in FIG. 5 through line D-D in FIG. 5 with the openable induction coil shown in the closed position and the cross sectional view rotated ninety degrees counterclockwise.
Figure 6A:
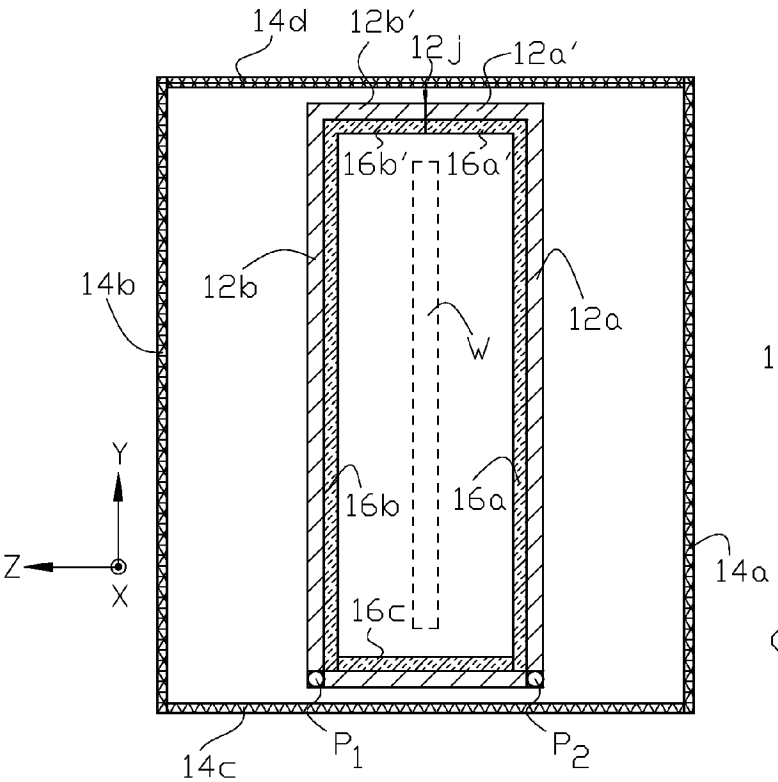
Figure 7E:
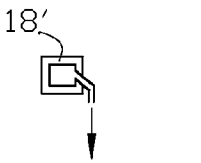
FIG. 7(*a*) is a partial top plan view of one example of a gas (air) curtain used with the electromagnetically shielded inductor assembly shown in FIG. 3(*a*).
Figure 7D:
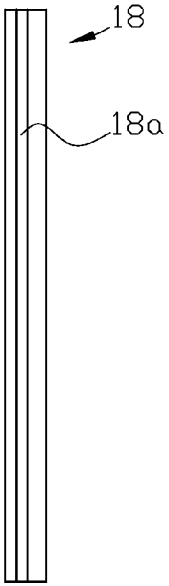
Figure 7B:
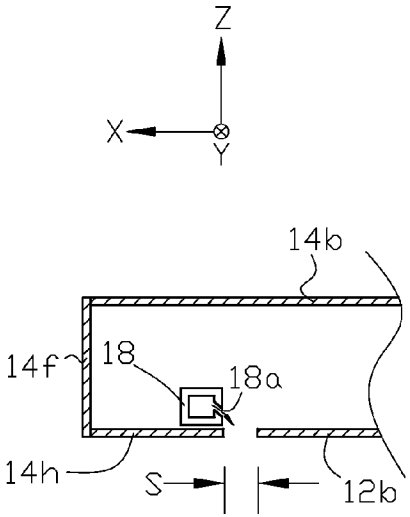
Figure 7C:
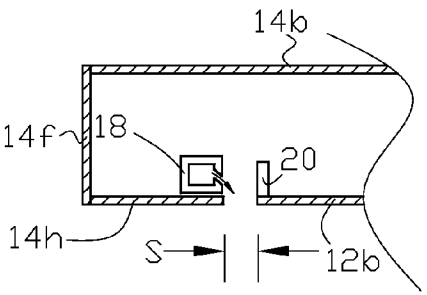
Figure 7A:
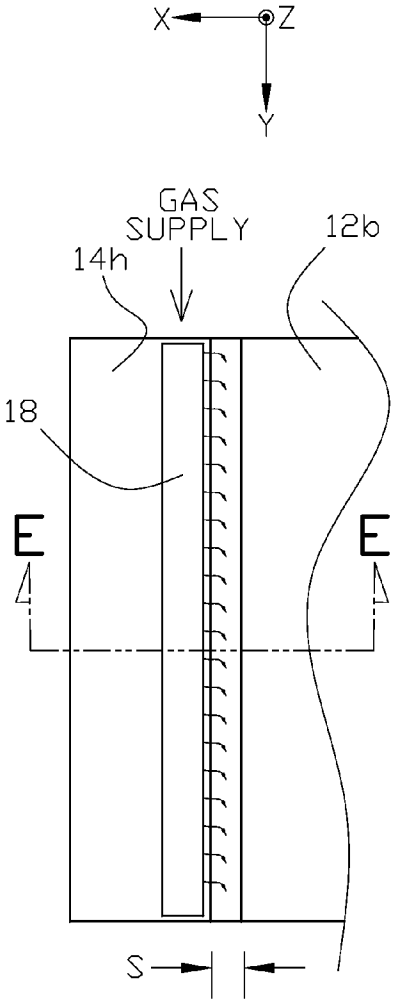

FIG. 5 is another example of the present invention that is similar to that in FIG. 3(*a*) except that non-magnetic and non-electrically conductive refractory (16*a*, 16*b* and 16*c*) is positioned between inner surface of openable induction coil 12 and the interior of the induction furnace when openable induction coil 12 is in the closed position as shown in FIG. 6(*a*). The refractory may be of any suitable form such as a refractory board material. As shown in FIG. 6(*b*) in this particular non-limiting example of the invention, refractory board sections 16*a* and 16*b*, including subsections 16*a*' and 16*b*', respectively, also pivot open with induction coil sections 12*a* and 12*b*, including subsections 12*a*' and 12*b*'.

As shown in the above examples of the invention, when the openable induction coil is in the closed position, an open space S, or gap, exists at least between the inner perimeters of fixed top section and bottom section of inner workpiece entry passage 14*g* and exit passage 14*h*, and the respective opposing outer perimeters of top section 12*b* and bottom section 12*a* of the openable induction coil in FIG. 3(*a*) (or the respective opposing perimeters of top section and bottom section of the openable induction coil and refractory material in FIG. 5). In some applications it may be necessary to create a barrier over or around open spaces S. One static method of accomplishing this is, for example, by fastening a strip of flexible or compressible material to the inner perimeters of the fixed top and bottom sections of each inner workpiece passage, or to the interfacing outer perimeters of the induction furnace, so that when the openable induction coil is moved to the closed position the flexible or compressible strip will seal open spaces S.

Figure 11:
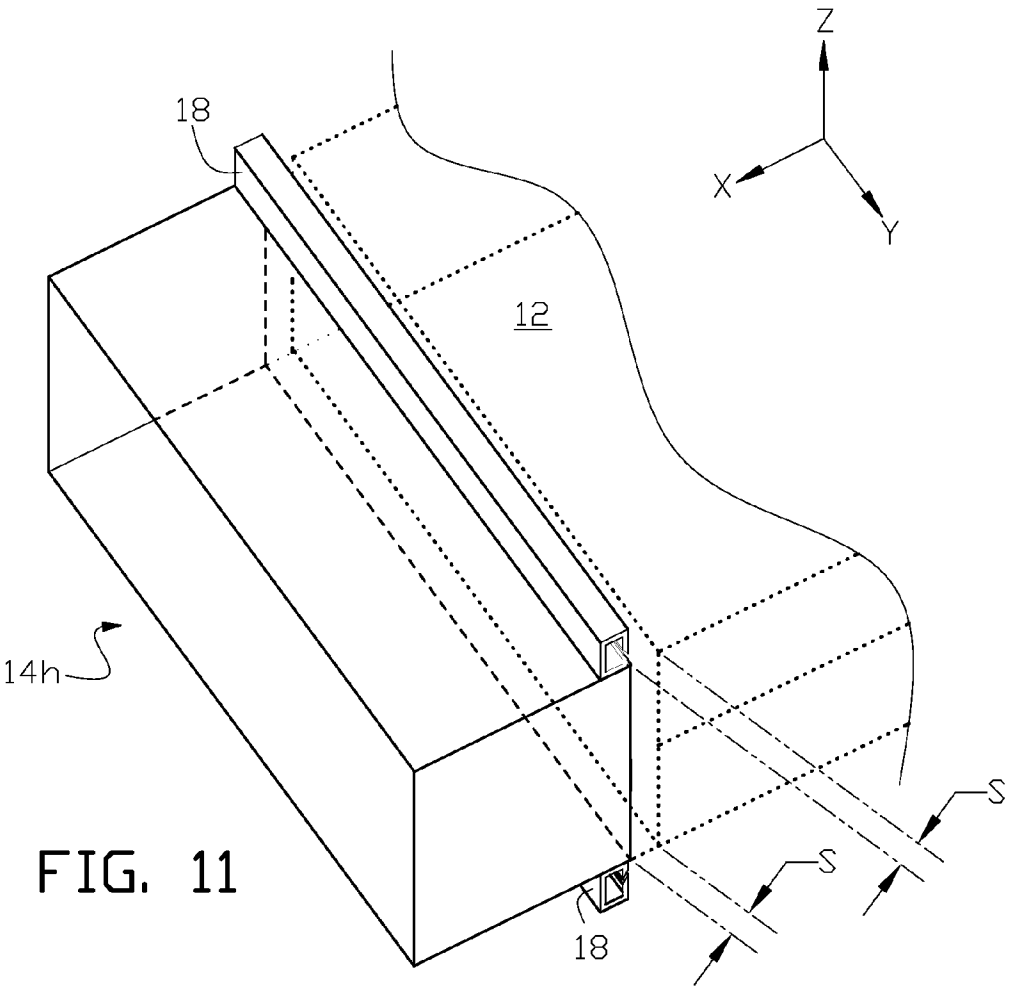
FIG. 11 is a partial isometric illustration of one example of an electromagnetically shielded inductor assembly of the present invention utilizing a gas (air) curtain.

Alternatively a flow of gas may be injected through each space S into the interior of the induction furnace from a dynamic gaseous (air) curtain across each space S when the openable induction coil is in the closed position. FIG. 7(*a*), FIG. 7(*b*) and FIG. 7(*d*) illustrate one method of establishing such an air curtain for the assembly shown in FIG. 3(*a*). As representatively shown in FIG. 11 for one top and bottom space S, distribution plenum or conduit 18 is installed across the exterior transverse of the inner perimeter of workpiece exit passage 14*h*. Gas is supplied from a suitable source to distribution conduit 18 adjacent to each opening, S, as illustrated in FIG. 7(*a*) for one of the four top and bottom openings (spaces) in the electromagnetically shielded inductor assembly used in this particular example of the invention. Gas flow out of conduit 18 through outlet port 18*a* is directed towards space S to effectively form a gas curtain over space S and inject the gas into the interior of the induction furnace. Baffle 20 can be optionally provided at the perimeters of the opposing ends of openable induction coil 12 to assist in directing the flow of the gas across the space as shown in FIG. 7(*c*). The quality of the gas, its temperature and the pressure at which it is supplied through the air curtain is dependent upon the operating environment inside the openable induction coil and the electromagnetically shielded end sections for a particular application. Various configurations of a conduit outlet port may be utilized. For example the outlet port may be configured as an extended nozzle structure 18' as shown in FIG. 7(*e*).

Similarly for the example of the invention utilizing non-magnetic and non-electrically conductive refractory 16*a*, 16*b*, and 16*c* as shown in FIG. 5, FIG. 6(*a*) and FIG. 6(*b*), a flow of gas may be injected through each space S into the interior of the refractory lined openable induction coil from a dynamic gaseous (air) curtain across each space, S, when the openable induction coil is in the closed position. FIG. 8(*a*), FIG. 8(*b*) and FIG. 8(*d*) illustrate one method of establishing such an air curtain for the assembly shown in FIG. 5. Gas is supplied from a suitable source to distribution conduit 18 adjacent to each opening S as illustrated in FIG. 8(*a*) for one of the four top ad bottom openings (spaces) in the electromagnetically shielded inductor assembly used in this particular example of the invention. Baffle 21 can be optionally provided at the perimeters of the opposing ends of refractory 16*a* to assist in directing the flow of the gas across the space as shown in FIG. 8(*c*). The quality of the gas, its temperature and the pressure at which it is supplied through the air curtain is dependent upon the operating environment inside the refractory lined openable induction coil and the electromagnetically shielded end sections for a particular application. Various configurations of a conduit outlet port may be utilized. For example the output port may be configured as an extended nozzle structure 18' as shown in FIG. 8(*e*).

Figure 12A:
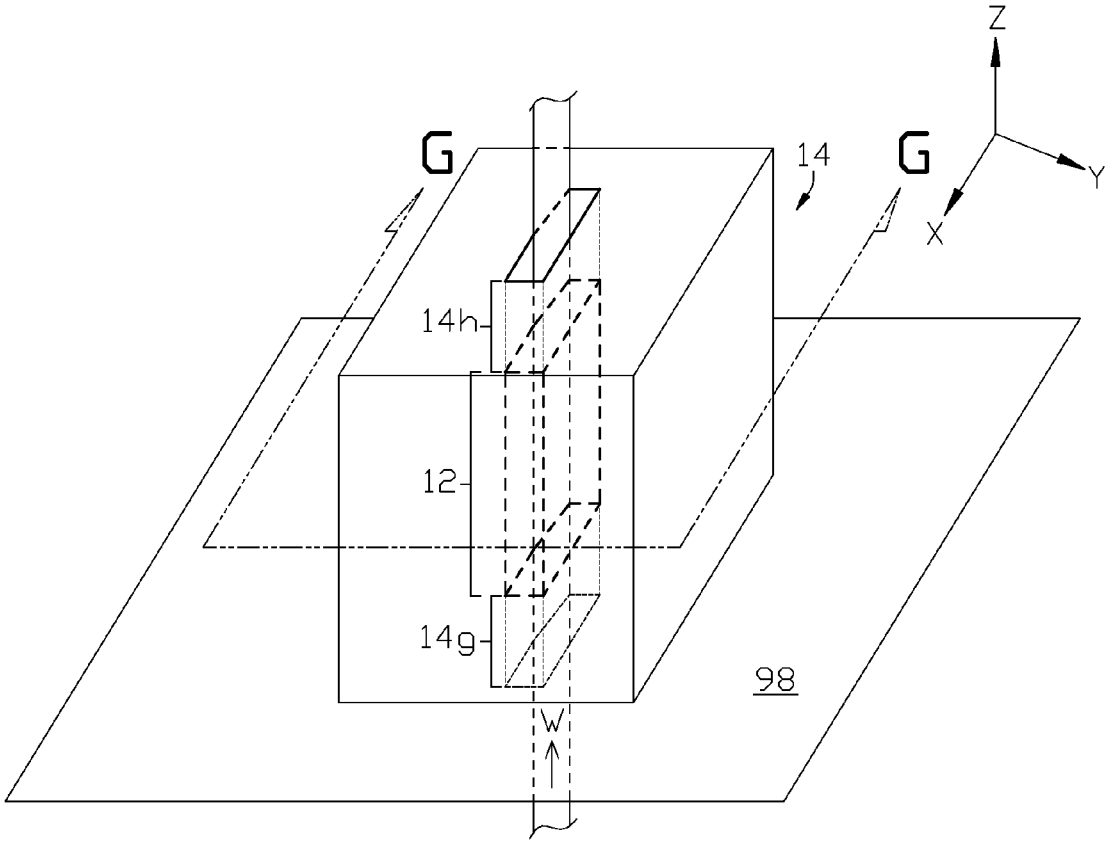
FIG. 12(*a*) is an isometric view of one example of an electromagnetically shielded inductor assembly of the present invention oriented for induction heating of a strip material moving in the vertical direction through the openable induction coil.
Figure 12B:
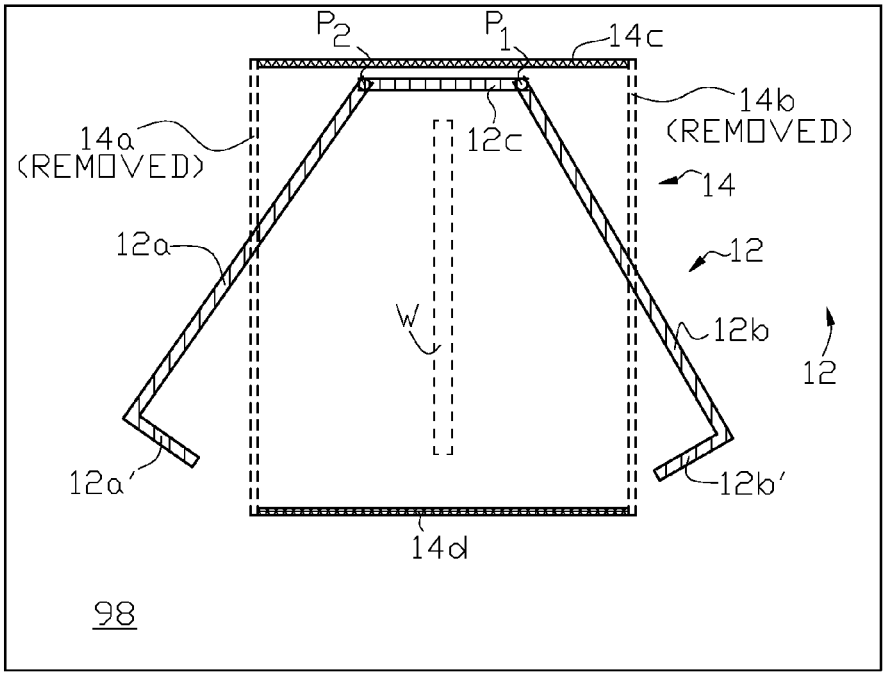

FIG. 12(*a*) and FIG. 12(*b*) illustrate an example of using an electromagnetically shielded inductor assembly of the present invention where openable induction coil 12 is longitudinally oriented in the vertical (Z) direction so that the workpiece, W, travels vertically and upwards through openable induction coil 12. In this orientation the electromagnetically shielded enclosure 14 can form a walk-in enclosed space, or a room, in which openable induction coil 12 is located. In this configuration induction coil 12 can be opened widely for convenient interior access to an individual standing in the enclosed walk-in space on platform 98.

Figure 13A:
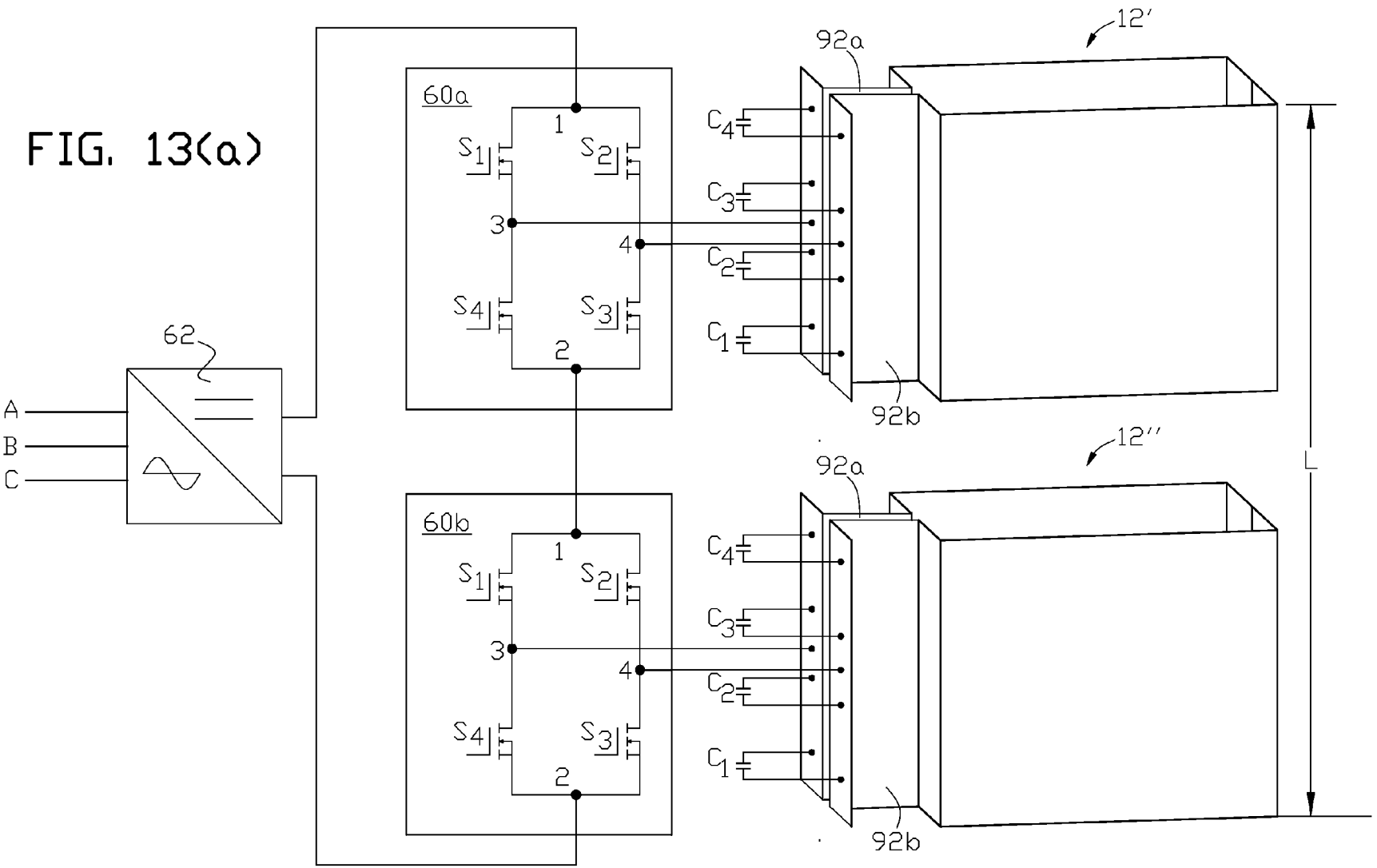
FIG. 13(*a*) is one example of an arrangement of multiple openable induction coils of the present invention and the supply of alternating current to the multiple openable induction coils.
Figure 13B:
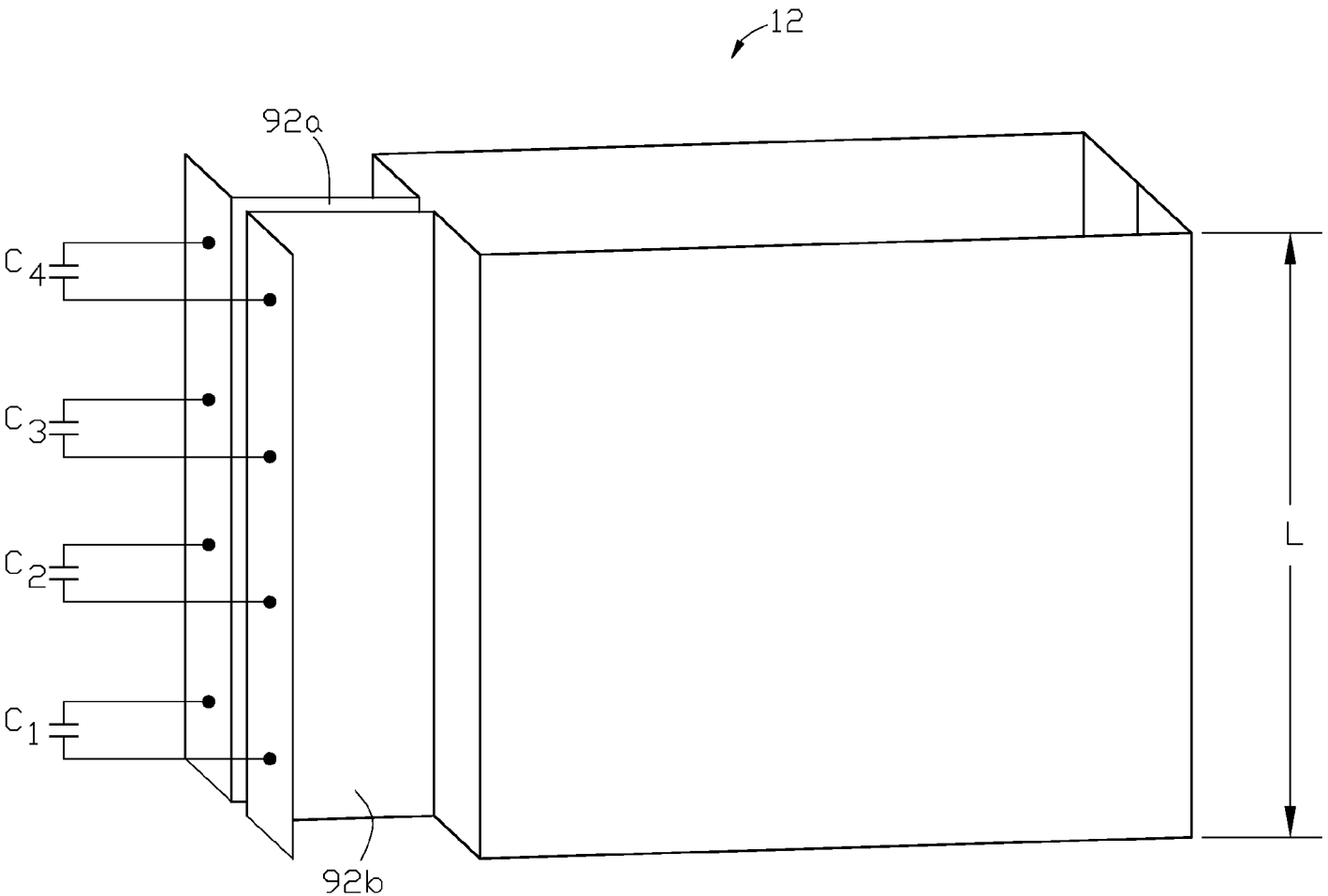
Figure 13C:
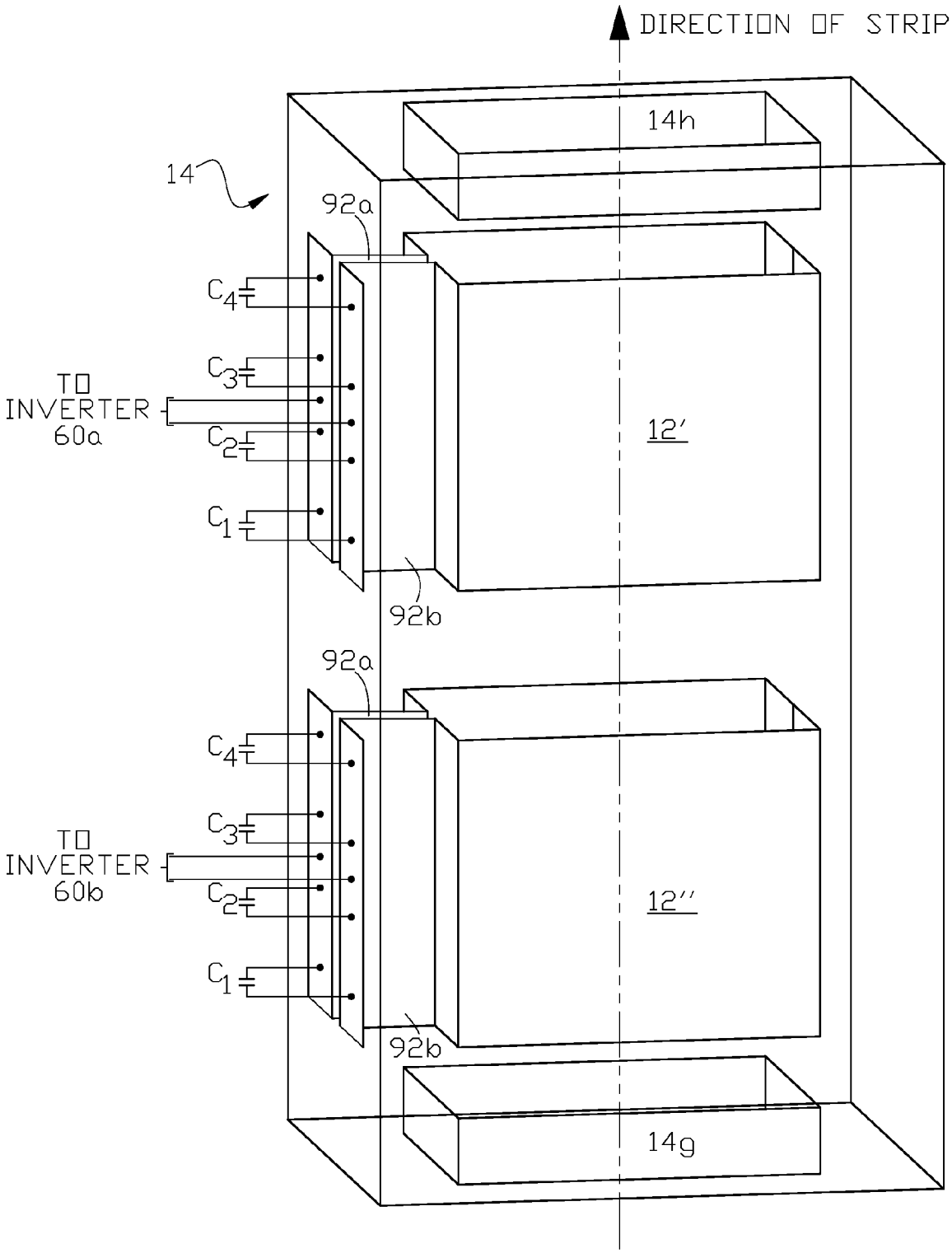

In some applications a longer length, L, of the openable induction coil is preferred to ensure that the strip material is gradually heated over a longer longitudinal distance of the strip, as opposed to rapid heating with a shorter length of an openable induction coil. FIG. 13(*a*) illustrates one such example of the present invention where an arrangement of two openable induction coils 12' and 12" is utilized to achieve extended induction heating length, L. In this particular example a separate high frequency inverter 60*a* and 60*b* supplies alternating current to each openable induction coil 12' and 12" via an optional separate distributed bank of tank capacitors $C_1$ through $C_4$ as also illustrated in FIG. 13(*b*). Each inverter may be a bridge inverter of suitable design and utilize switching devices $S_1$ through $S_4$. The advantage of using a distributed bank of capacitors, as opposed to a single tank (or tuning) capacitor bank is that reactive current path between the extended length induction coils and capacitive elements can be kept short since the distributed bank of capacitors can be collocated alongside the length of an induction coil, as opposed to locating a large capacitor bank external from the induction coil as shown for example in U.S. Pat. No. 6,399,929 B1. A single alternating current-to-direct current rectifier 62 can supply DC power across the inputs of both interconnected inverters 60*a* and 60*b* as shown in FIG. 13(*a*) to increase the DC voltage input across the pair of inverters. Rectifier alternating current input "A, B and C" may be from a suitable utility source. With this arrangement, a typical, but non-limiting, output of rectifier 62 can be from around 556 to 840 volts DC. In alternative examples of the invention the distributed bank of capacitors may be connected either in series or parallel across a coil's power terminal connections.

FIG. 13(*c*) illustrates another example of the present invention where the two openable coils 12' and 12" are installed in a common electromagnetically shielded enclosure 14 as previously described above.

While two inverters are shown in FIG. 13(*a*) and FIG. 13(*c*) the concept may be extended to any multiple number of inverters connected together with any number of openable induction coils, or to a single inverter and induction coil.

Figure 14B:
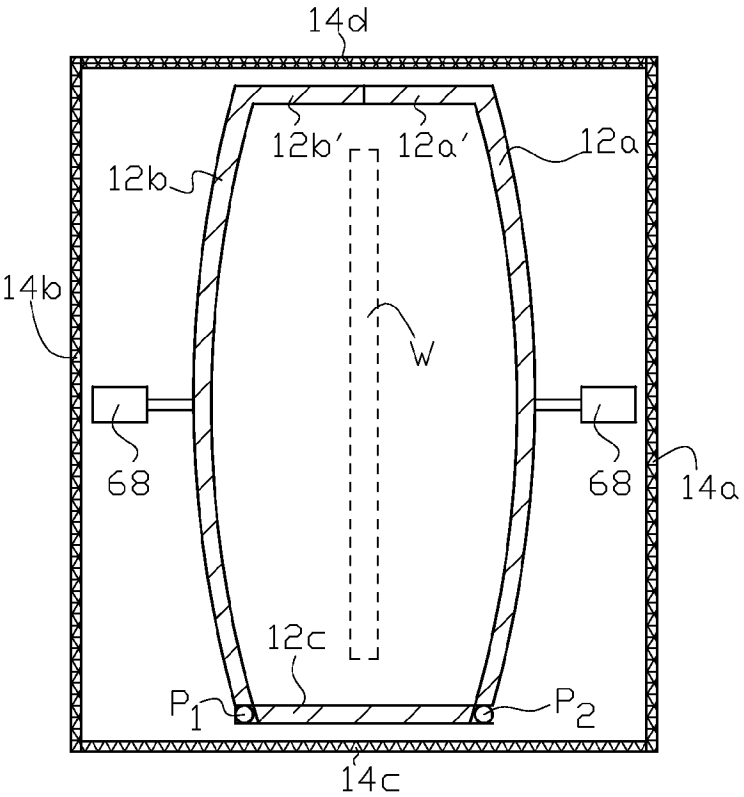
FIG. 14(*a*) and FIG. 14(*b*) illustrate one example of an electromagnetically shielded inductor assembly of the present invention wherein at least one of the induction coil sections can be flexibly adjusted.
Figure 14A:
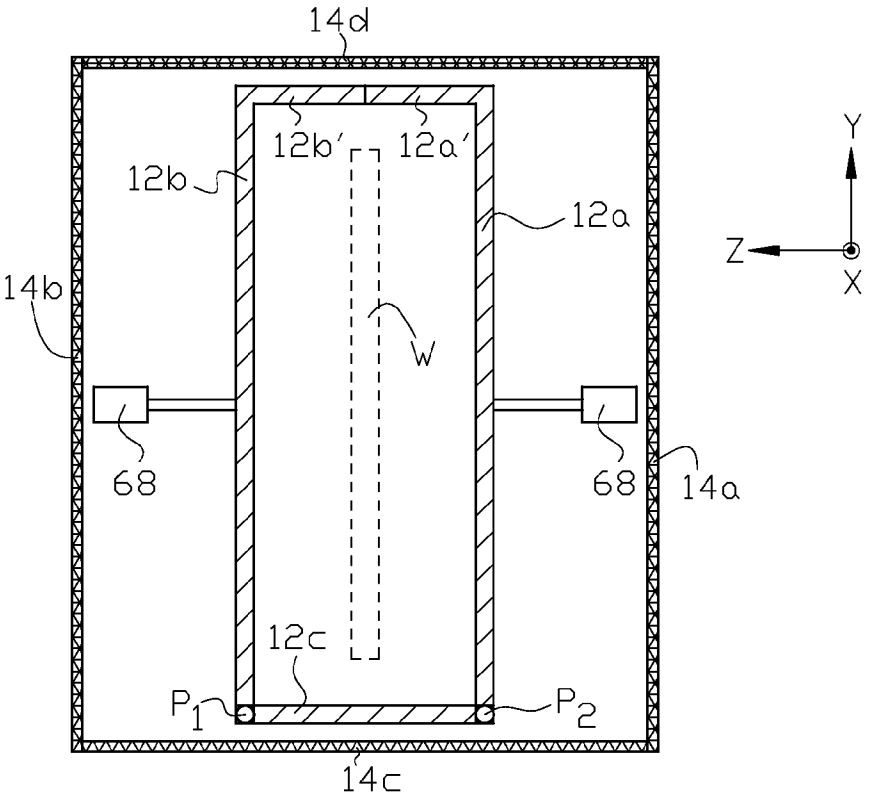

In other examples of the invention, at least one induction coil section, such as section 14*a* and/or 14*b* shown in the above examples, can be formed from a flexible material and attached to actuators 68 for flexing the coils as disclosed in US Patent Publication No. 2007/0187395 A1 and as shown in FIG. 14(*a*) and FIG. 14(*b*) to alter the electrical impedance of the induction coil load circuit.

While the induction coil utilized in the above examples of the invention is a single turn coil, other different configurations of induction coils may be used may be used in other examples of the invention.

While top, bottom and side terminology is used in some of the above examples of the invention, other orientations of the electromagnetically shielded inductor assembly of the present invention can be used, and such terminology is not limiting to application of the invention.

The present invention has been described in terms of preferred examples and embodiments. Equivalents, alternatives and modifications, aside from those expressly stated, are possible and within the scope of the invention.

The invention claimed is:

1. An electromagnetically shielded inductor assembly comprising:

an openable box-like induction coil forming at least one single turn coil when in a closed position to form an induction furnace in an interior furnace volume of the induction furnace with an entry perimeter and an exit perimeter, the openable box-like induction coil having a pair of pivot connections to allow a pivot opening of at least two opposing moveable sides of the openable box-like induction coil, an opposing longitudinal ends of the at least two opposing moveable sides of the openable box-like induction coil respectively forming the entry perimeter and the exit perimeter, the openable box-like induction coil having at least one pair of electric power terminal connections;

a box-like electromagnetically shielded enclosure surrounding the openable box-like induction coil, the box-like electromagnetically shielded enclosure having a separate movable side section facing each of the at least two opposing moveable sides of the openable box-like induction coil to allow the pivot opening of the at least two opposing moveable sides of the openable box-like induction coil at least partially through an installed plane of each of the separate moveable side sections of the box-like electromagnetically shielded enclosure when the separate moveable side sections of the box-like electromagnetically shielded enclosure are at least partially removed from the installed planes of the separate moveable side sections;

a workpiece entry passage and a workpiece exit passage within the box-like electromagnetically shielded enclosure, the workpiece entry passage and the workpiece exit passage respectively disposed at the opposing longitudinal ends of the openable box-like induction coil, the workpiece entry passage, the workpiece exit passage and the interior furnace volume of the induction furnace forming a path for a workpiece through the box-like electromagnetically shielded enclosure; and at least one gap in a region respectively between the entry and exit perimeters of the at least two opposing moveable sides of the openable box-like induction coil and an inner perimeter of the workpiece entry passage and the workpiece exit passage.

2. The electromagnetically shielded inductor assembly of claim 1 further comprising a flexible or a compressible material attached to the entry and exit perimeters of the at least two opposing moveable sides of the openable box-like induction coil, or the inner perimeters of the workpiece entry passage and the workpiece exit passage to seal each of the at least one gap when the openable box-like induction coil is in the closed position.

3. The electromagnetically shielded inductor assembly of claim 1 further comprising a means for supplying a flow of a gas through each of the at least one gap.

4. The electromagnetically shielded inductor assembly of claim 3 wherein the means for supplying the flow of the gas comprises:

a distribution conduit disposed transversely across the entry and exit perimeters of the at least two opposing moveable sides of the openable box-like induction coil, or the inner perimeters of the workpiece entry passage and the workpiece exit passage in the region of each of the at least one gap; and a gas source supplying the gas to the distribution conduit, the distribution conduit having at least one outlet passage for directing the flow of the gas from the at least one outlet passage towards each of the at least one gap when the openable box-like induction coil is in the closed position.

5. The electromagnetically shielded inductor assembly of claim 4 further comprising at least one baffle disposed on the entry and exit perimeters of the at least two opposing moveable sides of the openable box-like induction coil, or the inner perimeters of the workpiece entry passage and the workpiece exit passage to direct the flow of the gas towards the gap.

6. The electromagnetically shielded inductor assembly of claim 1 further comprising a bank of tank capacitors connected in parallel and distributed along the length of the openable box-like induction coil, the parallel connected bank of tank capacitors connected across the at least one pair of electric power terminal connections.

7. The electromagnetically shielded inductor assembly of claim 1 wherein the at least one single turn coil comprises a pair of single turn coils and the at least one pair of electric power terminal connections comprises a pair of electric power terminal connections for each one of the pair of continuous single turn coils, the openable box-like induction coil further comprising:

a separate bank of tank capacitors connected in parallel and distributed along the length of each one of the pair of continuous single turn coils, each of the separate bank of tank capacitors connected across the pair of electric power terminal connections of its respective one of the pair of single turn coils;

a pair of inverters, the alternating current output of each one of the pair of inverters connected exclusively to one of the separate bank of tank capacitors, the pair of inverters connected together in a parallel circuit; and a rectifier having its DC output connected across the parallel circuit.

8. An electromagnetically shielded inductor assembly for electric induction heating of a strip material passing through the electromagnetically shielded inductor assembly, the electromagnetically shielded inductor assembly comprising:

an openable box-like induction coil when in a closed position forms a continuous single turn induction furnace in an interior furnace volume with an entry perimeter and an exit perimeter, the openable box-like induction coil having a pair of pivot connections to allow a pivot opening of at least two opposing moveable sides of the openable box-like induction coil, an opposing ends of the at least two opposing moveable sides of the openable box-like induction coil respectively forming the entry perimeter and the exit perimeter, the openable box-like induction coil having at least one pair of electric power terminal connections; and a box-like electromagnetically shielded enclosure surrounding the openable box-like induction coil, the box-like electromagnetically shielded enclosure comprising:

a separate movable side section facing each one of the at least two opposing moveable sides of the openable box-like induction coil to allow the pivot opening of the at least two opposing moveable sides of the openable box-like induction coil at least partially through an installed plane of each of the separate movable side sections of the box-like electromagnetically shielded enclosure when the separate moveable side sections are at least partially removed from the installed planes of the separate moveable side sections;

a workpiece entry passage and a workpiece exit passage within the box-like electromagnetically shielded enclosure, the workpiece entry passage and the workpiece exit passage respectively disposed at the opposing ends of the openable box-like induction coil, the workpiece entry passage and the workpiece exit passage and the interior furnace volume of the induction furnace forming a path for the workpiece through the electromagnetically shielded enclosure; and at least one gap in a region respectively between the entry and exit perimeters of the at least two opposing moveable sides of the openable box-like induction coil and an inner perimeter of the workpiece entry passage and the workpiece exit passage.

9. The electromagnetically shielded inductor assembly of claim 8 further comprising a means for supplying a flow of a gas through each of the at least one gap.

10. The electromagnetically shielded inductor assembly of claim 9 wherein the means for supplying the flow of the gas comprises:

a distribution conduit disposed transversely across the entry perimeter and exit perimeter of the at least two opposing moveable sides of the openable box-like induction coil, or the inner perimeters of the workpiece entry passage and the workpiece exit passages in the region of each of the at least one gap; and a gas source supplying the gas to the distribution conduit, the distribution conduit having at least one outlet passage for directing the flow of the gas from the at least one outlet passage towards each of the at least one gap when the openable box-like induction coil is in the closed position.

* * * * *